United States Patent [19]

Robb

[11] 3,955,314

[45] May 11, 1976

[54] INFANT'S TOY

[75] Inventor: Sidney W. Robb, Maplewood, N.J.

[73] Assignee: The Raymond Lee Organization Inc., a part interest

[22] Filed: July 21, 1975

[21] Appl. No.: 597,640

[52] U.S. Cl. ..... 46/193
[51] Int. Cl.[2] ..... A63H 5/00
[58] Field of Search ..... 46/175 A, 193

[56] References Cited

UNITED STATES PATENTS 1,627,166 5/1927 Feldstein ..... 46/193
1,648,928 11/1927 Zadek ..... 46/193

*Primary Examiner*—Louis G. Mancene
*Assistant Examiner*—Robert F. Cutting

[57] ABSTRACT

A body is shaped and painted to resemble the head of a person. The body is hollow and contains an element that rattles around inside the cavity when the top is shaken. At the chin of the body, the body is so shaped and sized as to allow an infant to bite and teethe upon it. A plurality of differently textured regions on the rear and sides of the body have different tactile textures. A perfumed substance is placed at the nose of the body.

5 Claims, 4 Drawing Figures

INFANT'S TOY

SUMMARY OF THE INVENTION

The object of this invention is to produce a toy that will develop certain sensory abilities of an infant that plays with it whereby the infant's physical and mental development can be stimulated. The toy when shaken produces a rattle which stimulates the sense of hearing. The toy is brightly colored to stimulate the sense of sight. A selected region of the toy carries an odor which stimulates the sense of smell. The surface of the toy has different regions with tactile textures of various sorts, to stimulate the sense of touch. Finally, another region of the toy is so shaped and sized that an infant can teethe thereon.

DETAILED DESCRIPTION OF THE INVENTION

Figure 1:
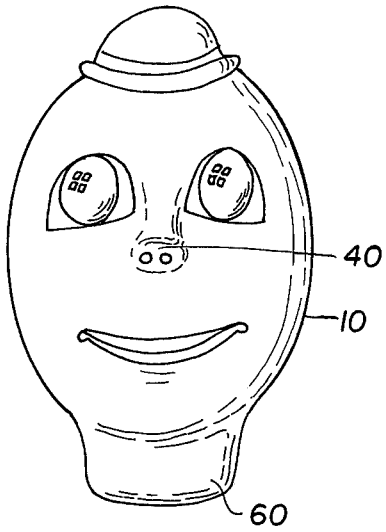
FIG. 1 shows a front view of the invention.
Figure 2:
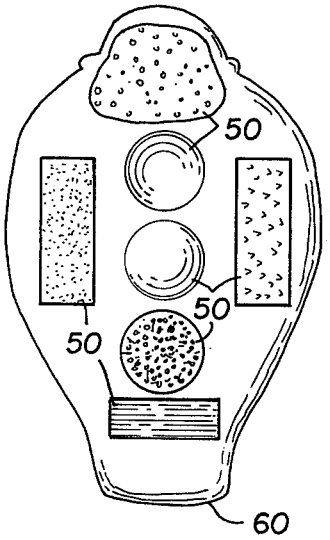
FIG. 2 shows a rear view of the invention.
Figure 3:
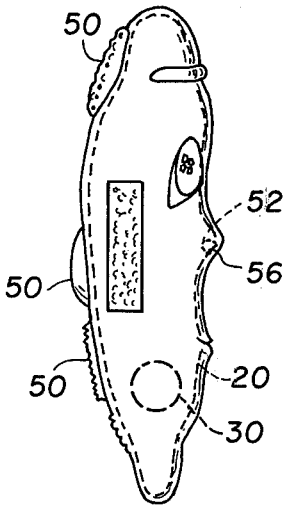
FIG. 3 shows a side view of the invention.

Referring now to FIGS. 1–3, a body 10 is shaped and painted to resemble the head of a person. The body is hollow as shown at 20 and contains a hard rubber sphere 30. The sphere is sufficiently smaller than the hollow to rattle around inside the body when the toy is shaken.

Typically, the body is made of plastic and is small enough to be held and moved easily by the infant.

A perfumed substance with a pleasant odor is applied to the body at point 40, where the nose is located. This substance can be a perfumed coating such as a paint with suitable additives. Alternatively, the body can have a recess in which a perfumed harmless substance 56 can be disposed. Such a recess can be formed as a nostril cavity 52 with substance 56 therein.

Figure 4:
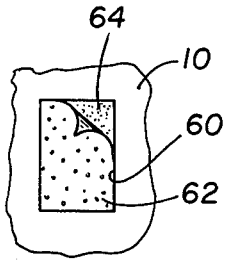
FIG. 4 is a detail view of a portion of the invention.

Distributed over the surface of the rear and sides of the body are various regions 50, each with its own distinctive tactile texture. These regions may for example have the textures of string (or fibrous material), sandpaper, foam rubber, deep felt, rubber "stipple," or other surfaces, and the regions themselves may be differently shaped, concave, convex, or undulating in height. Such substances can actually be incorporated into the surface of the body. For example a sheet of sandpaper can be glued into a suitable shallow recess of the body and the other substances can be suitably disposed in like manner. Such an arrangement is shown in FIG. 4 wherein shallow recess 60 in the body contains a sheet of sandpaper 62 held in place by glue 64.

Point 60 indicates the chin on the body. The body is thin enough at this point so that an infant can bite upon it, aiding in the teething process. The structure is sufficiently yielding avoid injury and is sufficiently strong not to be bitten through.

I claim:

1. An infant's toy, comprising:
- a body shaped like the head of a person, said body being hollow;
- a movable element located inside the body, said element being sufficiently smaller than the hollow to rattle therein when the body is shaken;
- a perfumed substance located on the outside of the body at approximately the location of the nose; and
- a plurality of differently textured regions disposed on the outer rear and side surfaces of the body, each region having a distinctive tactile texture.

2. The device of claim 1 wherein the chin of the body is so shaped and sized that the infant can bite and teethe upon it.

3. The toy of claim 2 wherein said regions are spaced from each other.

4. The toy of claim 3 wherein at least one of said surfaces has at least one shallow recess and a texture forming substance is disposed in said recess.

5. The toy of claim 4 wherein said nose has a nostril cavity and said perfumed substance is disposed in the nose cavity.

* * * * *